US009671187B2

(12) United States Patent
Colman

(10) Patent No.: US 9,671,187 B2
(45) Date of Patent: Jun. 6, 2017

(54) TRIGGER MODULE FOR AUTOMATIC FIRE ENABLED FIREARMS

(71) Applicant: Ronin B. Colman, Arlington, TX (US)

(72) Inventor: Ronin B. Colman, Arlington, TX (US)

( * ) Notice: Subject to any disclaimer, the term of this patent is extended or adjusted under 35 U.S.C. 154(b) by 0 days.

(21) Appl. No.: 15/080,565

(22) Filed: Mar. 24, 2016

(65) Prior Publication Data

US 2016/0282075 A1 Sep. 29, 2016

Related U.S. Application Data

(60) Provisional application No. 62/138,323, filed on Mar. 25, 2015.

(51) Int. Cl.
*F41A 19/46* (2006.01)
*F41A 19/15* (2006.01)

(52) U.S. Cl.
CPC ..... *F41A 19/46* (2013.01); *F41A 19/15* (2013.01)

(58) Field of Classification Search
CPC ..... F41A 19/45; F41A 19/46
USPC ..... 42/69.01–69.03, 41; 89/136, 132, 131, 89/150, 129.01, 127
See application file for complete search history.

(56) References Cited

U.S. PATENT DOCUMENTS 3,045,555 A 12/1959 Stoner
3,618,455 A * 11/1971 Plumer et al. ..... F41A 19/46 89/132
7,293,385 B2 11/2007 McCormick

* cited by examiner

*Primary Examiner* — Reginald Tillman, Jr.
(74) *Attorney, Agent, or Firm* — Russell D. Culbertson; The Culbertson Group, P.C.

(57) ABSTRACT

A trigger module is particularly suited for use with firearms having an upper receiver and a lower receiver which are connected in an operable condition and may be separated to expose a trigger mechanism area in the lower receiver. The trigger module includes a module housing including a first side wall spaced apart from a second side wall. An automatic sear mount is included on the module housing and an automatic sear is pivotally secured to the module housing on the automatic sear mount. An automatic sear biasing element is also mounted on the module housing. One or more trigger mechanism mounts are also included on the module housing and a trigger mechanism is secured to the module housing on the one or more trigger mechanism mounts.

13 Claims, 10 Drawing Sheets

Fig. 25A
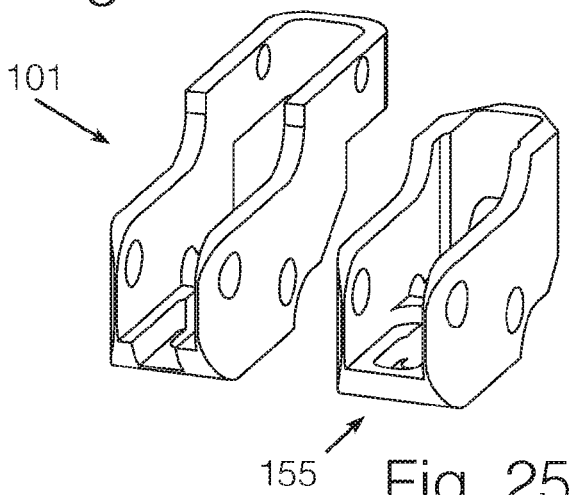
Fig. 25B
Prior Art
Fig. 26A
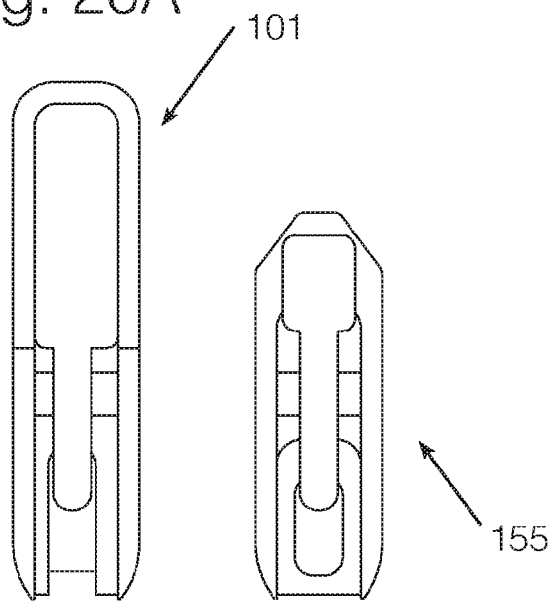
Fig. 26B
Prior Art

TRIGGER MODULE FOR AUTOMATIC FIRE ENABLED FIREARMS

CROSS-REFERENCE TO RELATED APPLICATION

The Applicant claims the benefit, under 35 U.S.C. §119 (e), of U.S. Provisional Patent Application No. 62/138,323 filed Mar. 25, 2015, and entitled "Trigger Module for Automatic Fire Enabled Firearms." The entire content of this provisional application is incorporated herein by this reference.

TECHNICAL FIELD OF THE INVENTION

The invention relates to trigger mechanisms for firearms that are capable of automatic fire. More particularly, the invention relates to a trigger module which contains a trigger mechanism for firearms capable of automatic fire.

BACKGROUND OF THE INVENTION

The military version of the AR15 rifle, including but not limited to the M16A1, M16A2, M16A3, M16A4, M4, M4A1, and the proposed M4A1-Plus are capable of operator-selected semi-automatic and full automatic fire. The fire control group is based on U.S. Pat. No. 3,045,555 to E. M. Stoner and makes use of a separate sear which allows proper operation of the firearm when automatic fire is selected. This additional sear is known as the "automatic sear," and often referred to as a "trip sear." According to U.S. Pat. No. 3,045,555, the automatic sear is spring biased and located within the lower receiver of the firearm and to the rear of the trigger components which include a hammer, trigger component, and an intermediate sear. The automatic sear functions to catch and release the hammer with the appropriate timing when automatic fire is selected. The spring bias for the automatic sear in this prior art arrangement is provided by a spring element operating between a surface of the automatic sear and a fire control selector for the fire control group. This fire control selector is also mounted on the lower receiver and used to select between semi-automatic operation, full automatic operation, and a safe condition in which the trigger mechanism is immobilized.

The modular trigger for the AR15 platform rifle shown in U.S. Pat. No. 7,293,385 to McCormick, has proven to be of utility by allowing easier removal and replacement of the trigger mechanism. It is possible to use a modular trigger such as that disclosed in U.S. Pat. No. 7,293,385 which will function with the automatic sear shown in U.S. Pat. No. 3,045,555. However, whether the trigger components are contained in a module such as that shown in U.S. Pat. No. 7,293,385 or otherwise, the automatic sear must be removed in order to remove the trigger module. The automatic sear must then be replaced after re-installing the trigger components, either via a modular trigger arrangement or otherwise. Removal and replacement of the automatic sear is complicated by the spring bias provided between the automatic sear and the fire control selector. This requirement of removing the automatic sear from the receiver to change the trigger mechanism prevents the installation/replacement of the prior art trigger module from being easily accomplished by a field level maintainer. Placement of the automatic sear as shown in U.S. Pat. No. 3,045,555 also constrains the design of enhanced function in the trigger assembly.

SUMMARY OF THE INVENTION

The present invention is directed to a trigger module that addresses the above-described and other shortcomings of the prior art. In particular, the present invention includes a trigger module that includes an automatic sear positioned and biased within the trigger module and independent of the fire control selector so as to simplify installation of the trigger module in a firearm, and to simplify removal of the trigger module as desired.

A trigger module according to the present invention is particularly suited for use with firearms having an upper receiver and a lower receiver which are connected in an operable condition and may be separated to expose a trigger mechanism area in the lower receiver. According to one aspect of the invention, such a trigger module includes a module housing including a first side wall spaced apart from a second side wall. An automatic sear mount is included on the module housing and an automatic sear is pivotally secured to the module housing on the automatic sear mount independent of the lower receiver. An automatic sear biasing element is also mounted on the module housing. One or more trigger mechanism mounts are also included on the module housing and a trigger mechanism is secured to the module housing on the one or more trigger mechanism mounts. The inclusion of the automatic sear on the module housing together with the automatic sear biasing arrangement also mounted on the module housing greatly simplifies installation and removal of the trigger mechanism in the firearm, while retaining the capability of full automatic fire operation.

These and other advantages and features of the invention will be apparent from the following description of representative embodiments, considered along with the accompanying drawings.

BRIEF DESCRIPTION OF THE DRAWINGS

FIG. 25A is a view in perspective of the trigger module housing shown in FIGS. 1 and 2.

FIG. 25B is a view in perspective of a prior art trigger module housing.

FIG. 26A is a top view of the trigger module housing shown in FIGS. 1 and 2.

FIG. 26B is a top view of the prior art trigger module housing shown in FIG. 25B.

DESCRIPTION OF REPRESENTATIVE EMBODIMENTS

Figure 2:
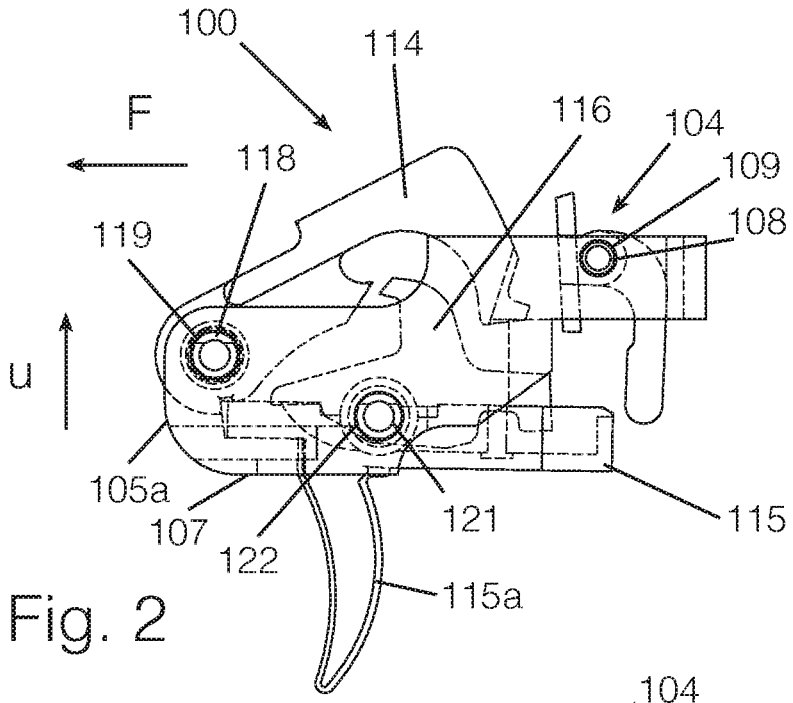
FIG. 2 is a side view of the trigger module shown in FIG. 1.
Figure 1:
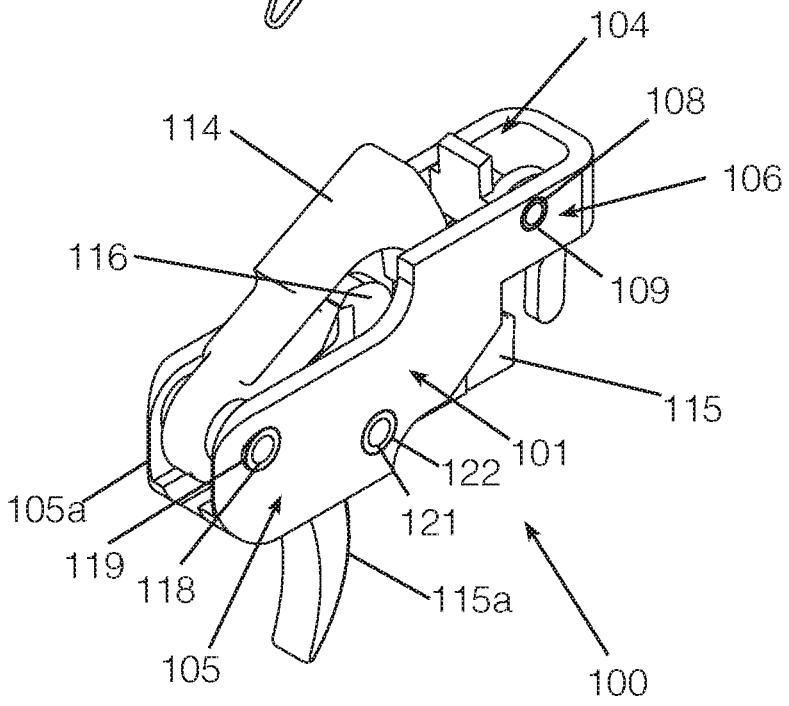
FIG. 1 is a view in perspective showing a trigger module according to one embodiment of the present invention.
Figure 4:
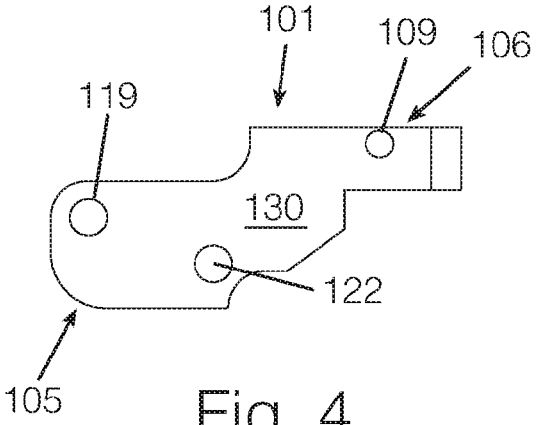
FIG. 4 is a right side view of the trigger module housing shown in FIG. 3.
Figure 5:
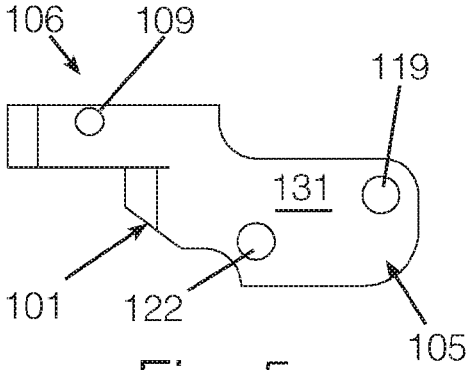
FIG. 5 is a left side view of the trigger module housing shown in FIG. 3.
Figure 6:
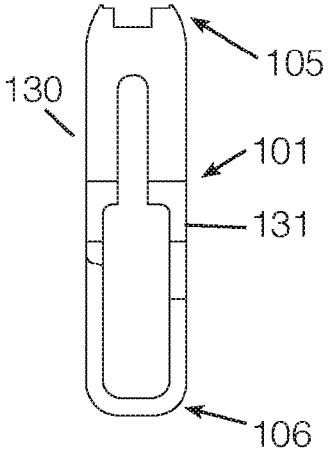
FIG. 6 is a bottom view of the trigger module housing shown in FIG. 3.
Figure 7:
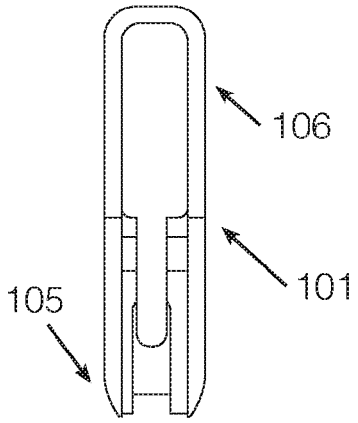
FIG. 7 is a top view of the trigger module housing shown in FIG. 3.
Figure 3:
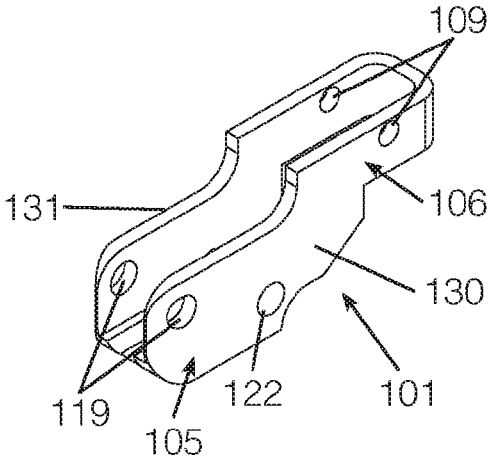
FIG. 3 is a view in perspective of the trigger module housing shown in FIG. 1.
Figure 27:
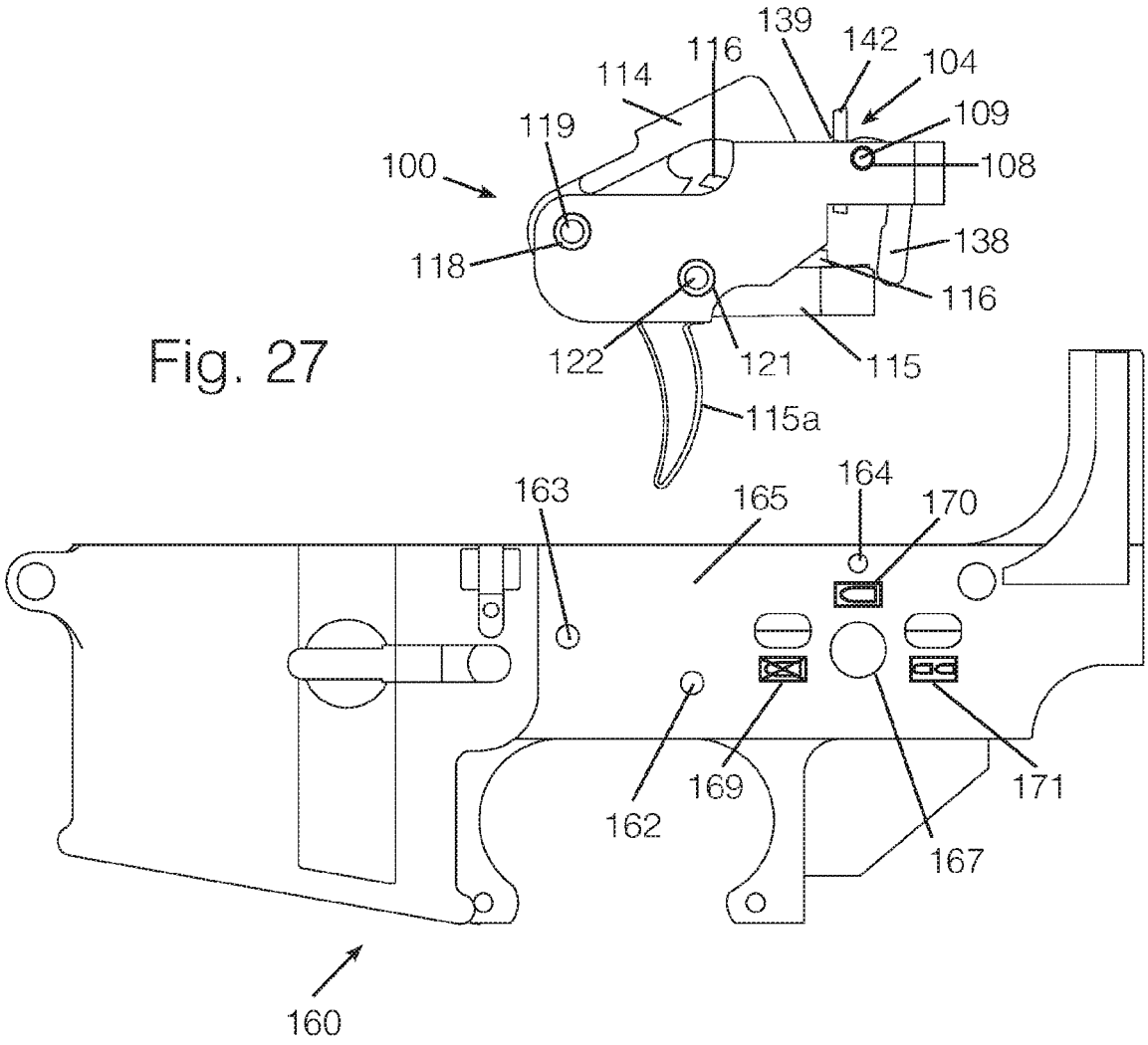
FIG. 27 is a side view of a lower receiver of a firearm with the trigger module shown in FIGS. 1 and 2 positioned above the trigger assembly receiving area of the lower receiver in position to be lowered into an operating position in the lower receiver.
Figure 28:
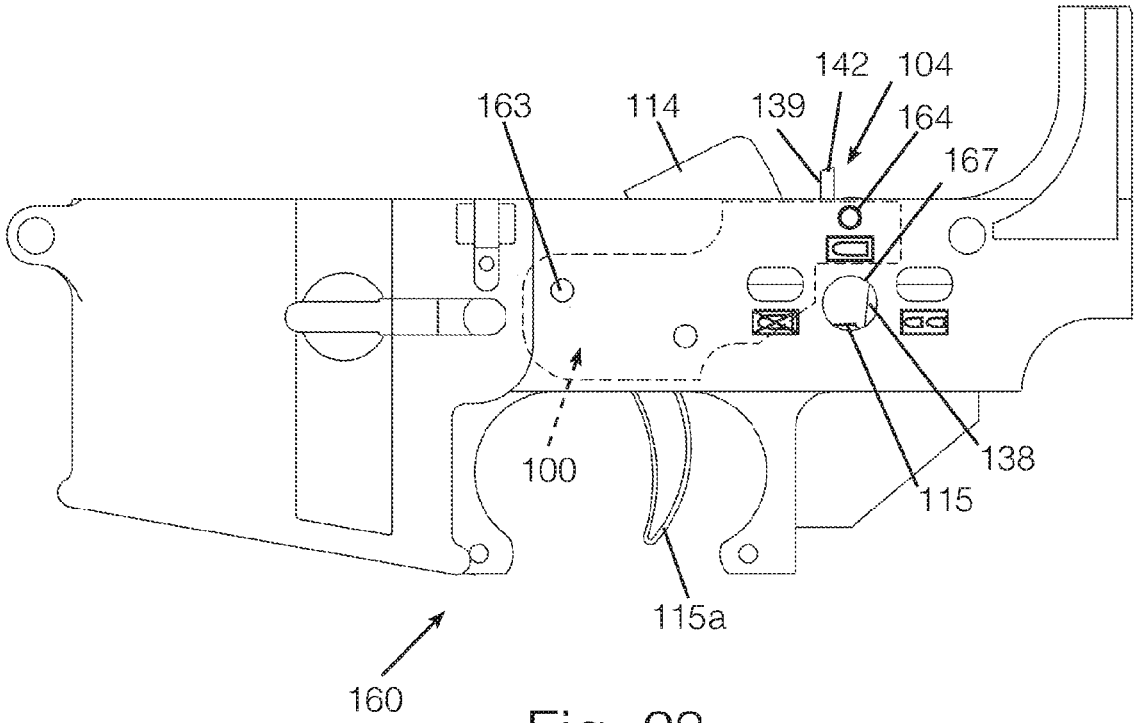
FIG. 28 is a side view similar to FIG. 27, but with the trigger module placed in the operating position in the lower receiver with the side profile of the module housing shown in dashed (hidden) lines.
Figure 29:
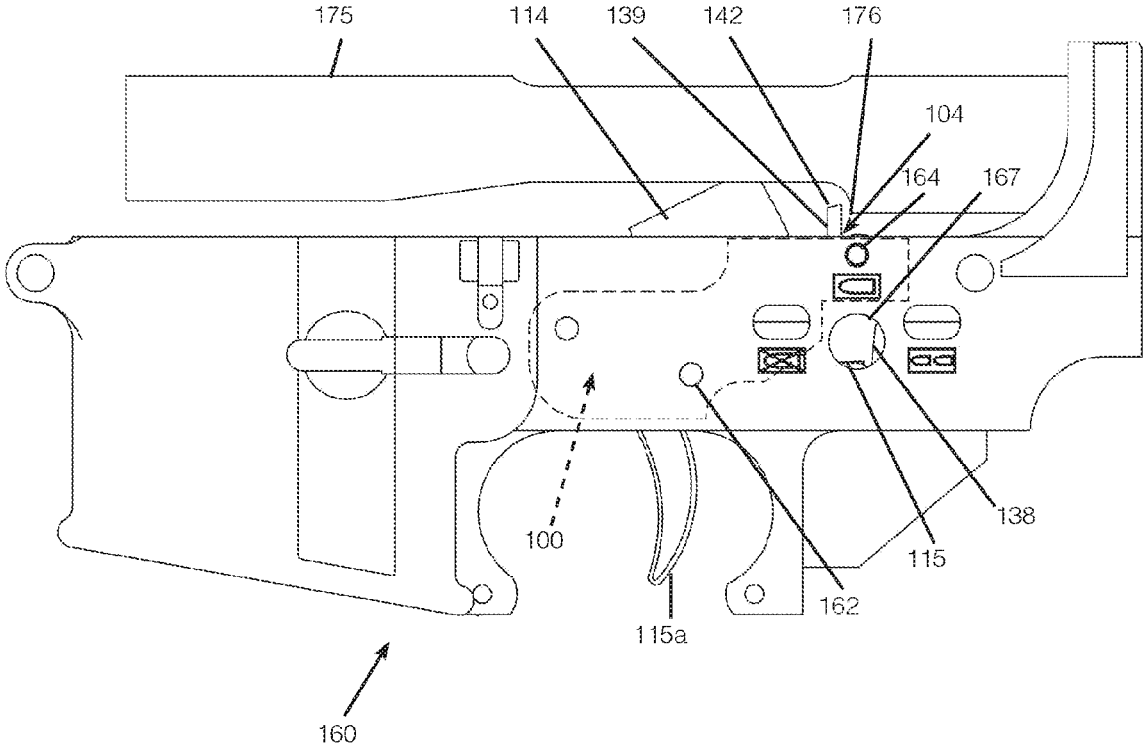
FIG. 29 is a side view similar to FIG. 28, but also showing the bolt carrier which is mounted within the upper receiver of the firearm.

FIGS. 1 and 2 will be referenced below to describe a trigger module 100 according to one embodiment of the present invention. FIGS. 3 through 24 will be referenced to describe various components of trigger module 100. FIGS. 25A and 25B and FIGS. 26A and 26B will be referenced to describe certain differences between trigger module 100 and a prior art trigger module. FIGS. 27 through 29 will be referenced below to describe how trigger module 100 is placed in an operating position in a firearm.

In the following description and claims, terms such as "behind," "above," "below," "upwardly," and "downwardly," for example, may be used to describe the relative position of one element with respect to another. These positional terms will be used in the claims and following description in accordance with the orientation of trigger module 100 shown in FIG. 2. The forward direction (from the rear to the front of trigger module 100) is indicated by the arrow F in FIG. 2, while the upward direction is indicated by arrow U in FIG. 2. The directions indicated by arrow F and arrow U may also be reference in certain later figures, and it will be appreciated that these directions are the same as in FIG. 2.

Referring to FIGS. 1 and 2, trigger module 100 includes a module housing 101 on which is mounted an automatic sear shown generally at 104 and a trigger mechanism including a number of different components which will be called out below. Module housing 101 includes a base section shown generally at 105 and an automatic sear section shown generally at 106. A front of module housing 101 is shown at 105*a* and a bottom of the module housing is shown at 107 in FIG. 2. Automatic sear 104 is supported on module housing 101 on an automatic sear mount which in this case includes automatic sear pin 108 received in automatic sear pin receiving openings 109 formed in module housing 101. In the example of FIGS. 1 and 2, the trigger mechanism includes a hammer 114, trigger component 115 (including a trigger lever or actuator part 115*a*), and intermediate sear 116. These trigger mechanism components are mounted on module housing 101 on trigger mechanism mounts, which, in this example, include a hammer pin 118 and a trigger pin 121. Hammer pin 118 is received in hammer pin openings 119 in module housing 101 to allow the hammer to pivot about a hammer pivot axis in the operation of the trigger mechanism (the hammer pivot axis comprising the longitudinal axis of the hammer pin in this embodiment). Trigger pin 121 is received in openings 122 of module housing 101 and supports trigger component 115 and intermediate sear 116. It will be noted that each of the pins 108, 118, and 121 in this illustrated embodiment includes a respective pin receiving opening through which a respective pin may be received to retain trigger module 100 in an operating position in a firearm. One or more of pins 108, 118, and 121 may be located on trigger module 100 so as to align with a respective OEM pin receiving opening in the receiver of a firearm in which the trigger module is intended to be installed in the operating position. Alternatively, trigger module 100 may be retained in an operating position in the firearm in some other fashion which does not employ an opening in one or more of the pins 108, 118, and 121

Referring to FIGS. 3 through 7, module housing 101 includes a first side wall 130 and a second side wall 131. Sidewalls 130 and 131 are spaced apart from each other sufficiently to receive automatic sear 104 and the various components of the trigger mechanism there between and allow proper operation of the automatic sear 104 and trigger mechanism components. The various pin openings 109, 119, and 122 are formed in sidewalls 130 and 131 with each pair of openings aligned so as to receive the respective pin as shown in FIGS. 1 and 2. It will also be appreciated that the overall width of module housing 101 is such that the module housing may be received in the desired operating position within the firearm receiver as will be described further below in connection with FIG. 27.

Figure 10:
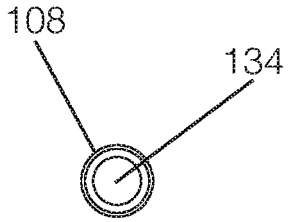
FIG. 10 is an end view of the automatic sear pin shown in FIG. 8.
Figure 9:
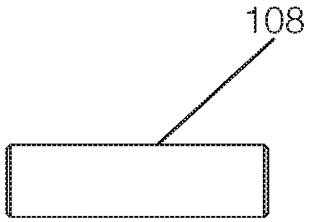
FIG. 9 is a side view of the automatic sear pin shown in FIG. 8.
Figure 8:
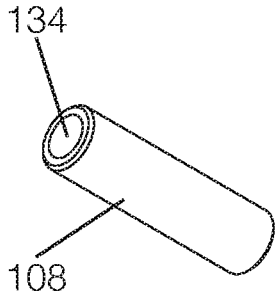
FIG. 8 is a view in perspective of an automatic sear pin which may be used in the trigger module housing shown in FIG. 3.

FIGS. 8 through 10 show automatic sear pin 108 separately from the trigger module 100. In this embodiment automatic sear pin 108 includes a pin opening 134 there through.

Figure 13:
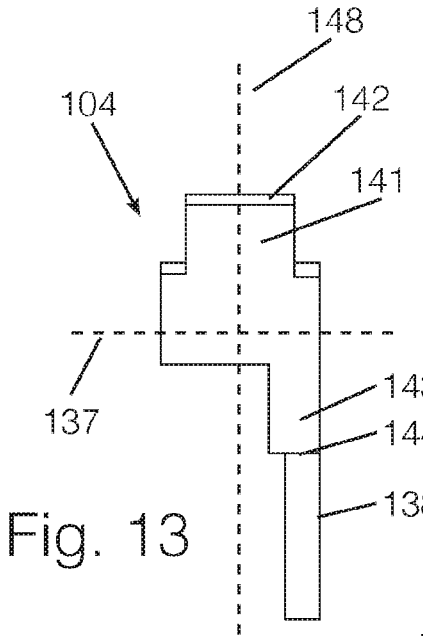
FIG. 13 is a front view of the automatic sear shown in FIG. 11.
Figure 15:
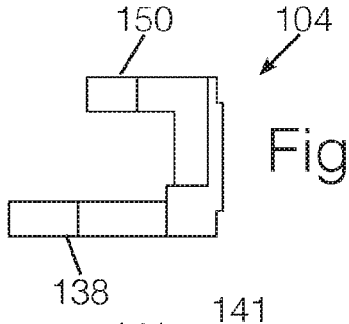
FIG. 15 is a bottom view of the automatic sear shown in FIG. 11.
Figure 12:
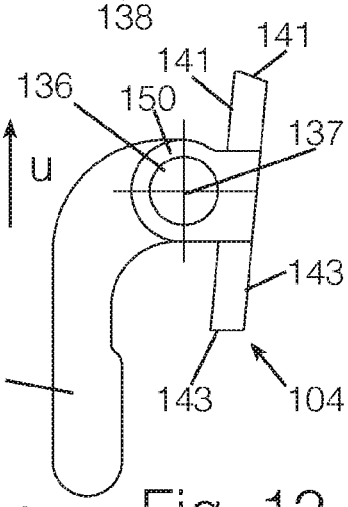
FIG. 12 is a left side view of the automatic sear shown in FIG. 11.
Figure 14:
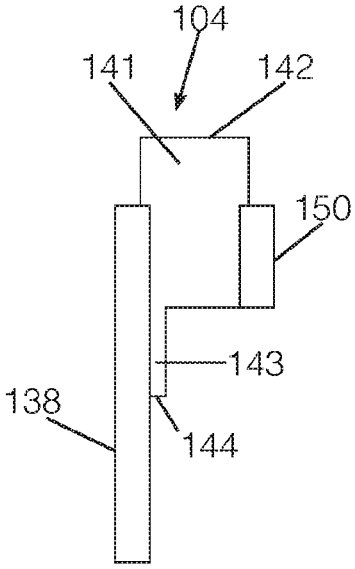
FIG. 14 is a rear view of the automatic sear shown in FIG. 11.
Figure 11:
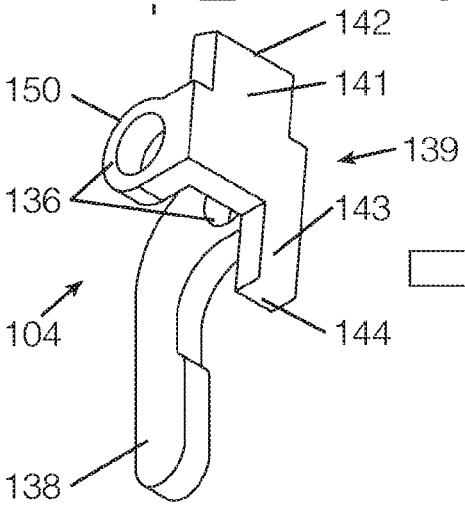
FIG. 11 is a view in perspective of the automatic sear shown in the embodiment of FIGS. 1 and 2.
Figure 16:
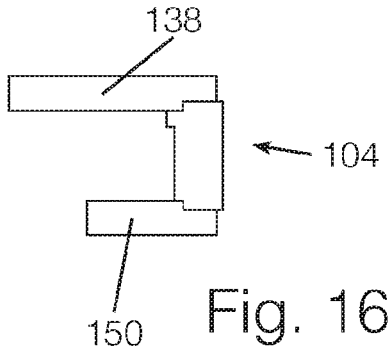
FIG. 16 is a top view of the automatic sear shown in FIG. 11.
Figure 17:
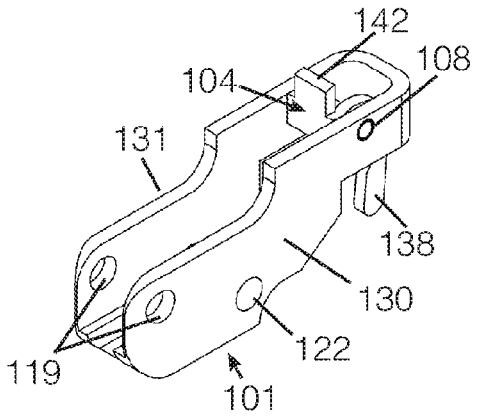
FIG. 17 is a top perspective view of the module housing of the embodiment of FIG. 1 with the automatic sear mounted in an operating position within the module housing.
Figure 18:
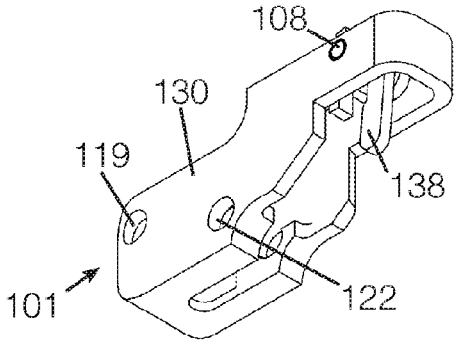
FIG. 18 is a bottom perspective view of the module housing and automatic sear shown in FIG. 17.

As shown in FIGS. 11 through 16, automatic sear 104 includes an automatic sear pin receptacle 136 which defines an automatic sear pin receptacle axis (this axis shown specifically in FIGS. 12 and 13 at reference numeral 137). Automatic sear 104 also includes a tail part 138 and a head part shown generally at 139. Head part 139 includes an upper portion 141 extending upwardly with respect to the automatic sear pin receptacle 136 and terminating in an upper extremity 142 which provides a bolt carrier engagement portion of the automatic sear 104. Head part 139 also includes a lower portion 143 extending downwardly with respect to the automatic sear pin receptacle 136 and terminating in a lower extremity 144. As is apparent particularly from the views of FIG. 11 and FIG. 13, lower portion 143 of head part 139 has a narrower dimension than the upper portion 141 of the head part 139 in the direction parallel to the automatic sear pin receptacle axis 137. Also, the lower portion 143 of head part 139 is eccentric with respect to a centerline 148 of the automatic sear 104 (the centerline 148 shown in FIG. 13 extends transverse to the automatic sear pin receptacle axis 137). It will be appreciated particularly from the view of FIG. 11 that automatic sear pin receptacle 136 in this illustrated embodiment of the invention includes two separate openings through parts on either lateral side of automatic sear 104. One opening making up a portion of automatic sear pin receptacle 136 is formed at an upper portion of tail part 138 while the other opening making up the other portion of the automatic sear pin receptacle 136 is formed on a tab 150 projecting from head part 139.

Figure 19:
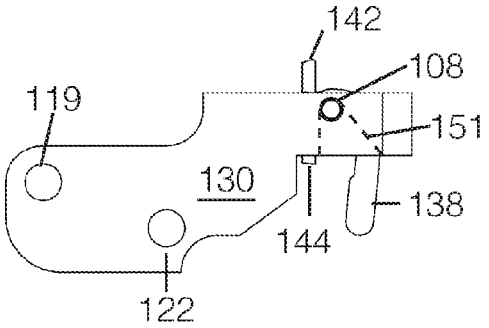
FIG. 19 is a side view of the module housing and automatic sear shown in FIG. 17.
Figure 20:
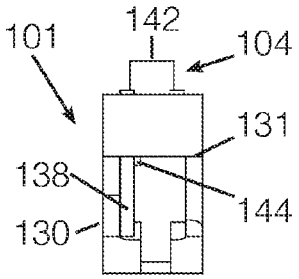
FIG. 20 is a rear view of the module housing and automatic sear shown in FIG. 17.
Figure 21:
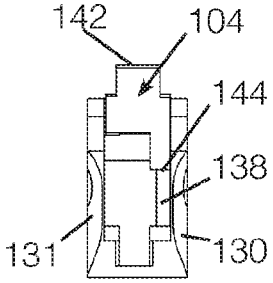
FIG. 21 is a front view of the module housing and automatic sear shown in FIG. 17.
Figure 22:
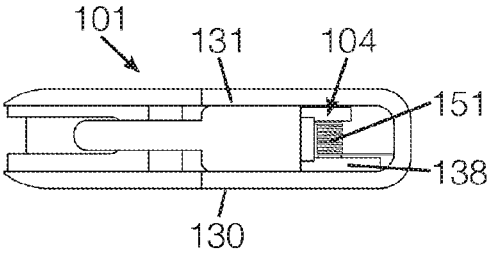
FIG. 22 is a top view of the module housing and automatic sear shown in FIG. 17.
Figure 23:
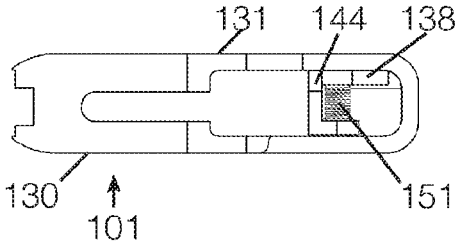
FIG. 23 is a bottom view of the module housing and automatic sear shown in FIG. 17.

FIGS. 17 through 23 show automatic sear 104 in an operating position within module housing 101. This is the same position of automatic sear 104 shown in FIGS. 1 and 2. Referring particularly to FIGS. in 19, 22, and 23, automatic sear 104 is biased by an automatic sear biasing spring 151. FIG. 19 shows the approximate position of the legs of the torsion spring making up automatic sear biasing spring 151. A first leg (the longer leg in FIG. 19) acts against a portion of module housing 101, whereas the second leg of automatic sear biasing spring 151 acts against the head portion 139 of automatic sear 104 to the bias automatic sear clockwise about the longitudinal axis of pin 108 shown in FIG. 19. Thus the spring bias of automatic sear 104 according to this embodiment of the invention is accomplished within the trigger module 100 entirely independently of any structure outside of the trigger module. This biasing arrangement for automatic sear 104 greatly simplifies the installation of the trigger module 100 and makes it possible for the installation to be performed under field conditions.

Figure 24:
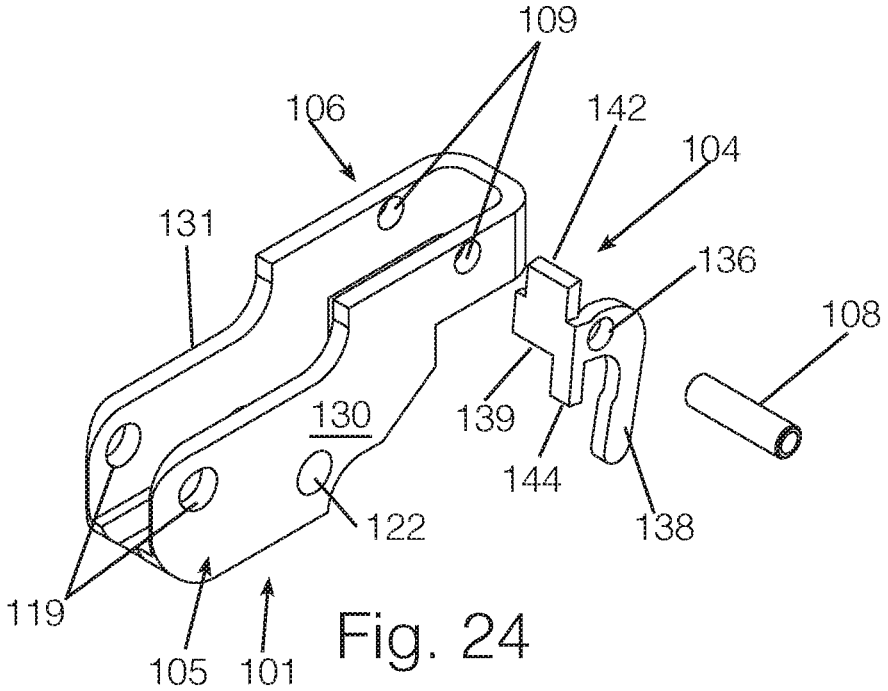
FIG. 24 is an exploded top perspective view of the module housing and automatic sear shown in FIG. 17.

FIG. 24 shows an exploded view of housing module 101, automatic sear 104, and automatic sear pin 108.

FIGS. 25A and 25B and FIGS. 26A and 26B show certain differences between a module housing 101 according to the embodiment illustrated herein and a prior art trigger module housing 155. As compared to prior art trigger module housing 155, module housing 101 includes the automatic sear section 106 projecting rearwardly from an upper part of the base section 105 of the housing. Pin openings 109 receiving automatic sear 104 are positioned in this automatic sear section 106 of module housing 101. Prior art trigger module housing 155 includes no such automatic sear section and no provision for mounting an automatic sear thereon.

FIG. 27 shows trigger module 100 together with a portion of a firearm lower receiver 160 in which the trigger module may be installed in an operating position. The particular lower receiver illustrated for purposes of example in FIG. 27 comprises the lower receiver of an M16 rifle, and trigger module 100 is specifically adapted for use in the M16 model rifle. The portion of the lower receiver 160 shown in FIG. 27 includes three pin receiving openings associated with an OEM trigger mechanism for the M16 rifle. These three openings are a trigger pin receiving opening 162, a hammer pin receiving opening 163, and an automatic sear pin receiving opening 164. Although not shown in this side view, it will be appreciated that lower receiver 160 includes an opposite side wall spaced apart from the side wall 165 to define a trigger assembly receiving area within the lower receiver. The opposite side wall which is not shown in this side view will include pin openings corresponding to pin openings 162, 163, and 164. Lower receiver 160 also includes an opening 167 adapted to receive a selector (not shown in the view of FIG. 27 but well known to those familiar with the M16 rifle) which may be positioned in any one of three operating conditions for the firearm. One position is a safety position pointing to safety indicator 169. A second position is a semiautomatic position pointing to indicator 170, while the third position is a full automatic position pointing to indicator 171. These different positions for the selector of an M16 rifle as well as the cooperation with the trigger mechanism and the automatic sear are well known to those of ordinary skill in the art and will not be described further here.

FIG. 28 shows the portion of the lower receiver 160 with trigger module 100 lowered into an operating position within the lower receiver. It will be noted from FIG. 28 that when trigger module 100 is placed in the operating position in this particular embodiment, trigger pin opening 122 of the module aligns with the OEM trigger pin opening 162, hammer pin opening 119 of the module aligns with OEM hammer pin opening 163, and automatic sear pin opening 109 of the module aligns with automatic sear pin opening 164. Thus suitable pins may be inserted through openings 162, 163, and 164 (and aligned pin openings 122, 119, and 109) to retain module 100 in the operating position.

FIG. 29 includes a representation of a portion of the bolt carrier 175 which is mounted on the upper receiver of an M16 rifle (the upper receiver not being shown in this view). As is known in the art, bolt carrier 175 travels back and forth along its longitudinal axis in the course of operation of the firearm. Automatic sear 104 of the trigger module 100 cooperates with bolt carrier 175 to release hammer 114 at the appropriate time in the full automatic operation of the firearm. Specifically a sear abutting surface 176 on bolt carrier 175 contacts the upper extremity 142 of the automatic sear head 139 to rotate automatic sear 104 in a releasing movement counterclockwise in the orientation of FIG. 29 so that the automatic sear releases hammer 114 at the point at which the bolt carrier returns to the full forward, firing position. This is the standard operation of the automatic sear in an M16 rifle as is well known to those of ordinary skill in the field and as described in detail in U.S. Pat. No. 3,045,555 to E. M. Stoner (the entire content of which is incorporated herein by this reference). However, automatic sear 104 according to the present invention is mounted within the module housing 101 of trigger module 100, and thus poses no impediment to replacing the trigger mechanism with another trigger module as desired even under field conditions.

As used herein, whether in the above description or the following claims, the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A trigger module for use with a firearm having an upper receiver and a lower receiver which are connected in an operable condition and may be separated to expose a trigger mechanism area in the lower receiver, the trigger module including:

(a) a module housing including a first side wall spaced apart from a second side wall;

(b) an automatic sear mount on the module housing, the automatic sear mount comprising an automatic sear pin received in an automatic sear pin receiving opening in each of the first side wall and the second side wall;

(c) an automatic sear pivotally secured to the module housing on the automatic sear pin;

(d) an automatic sear biasing element mounted on the module housing;

(e) one or more trigger mechanism mounts on the module housing;

(f) a trigger mechanism secured to the module housing on the one or more trigger mechanism mounts;

(g) the module housing, automatic sear pin, automatic sear, automatic sear biasing element, and trigger mechanism being movable together as a single unit to and from an operating position in the lower receiver; and (h) wherein when the module housing, automatic sear pin, automatic sear, automatic sear biasing element, and trigger mechanism are placed together as the single unit in the operating position in the lower receiver, a pin receiving opening of the automatic sear pin and the automatic sear pin receiving opening in each of the first side wall and the second side wall each align with a pin receiving opening of the lower receiver.

2. The trigger module of claim 1 wherein the automatic sear includes a bolt carrier engagement portion located, with respect to a front of the module housing, behind a hammer pivot axis of the trigger mechanism, the hammer pivot axis comprising an axis at which a hammer component of the trigger mechanism pivots in the operation of the trigger mechanism.

3. The trigger module of claim 2 wherein the bolt carrier engagement portion of the automatic sear is located above the hammer pivot axis.

4. The trigger module of claim 1 wherein the automatic sear includes a bolt carrier engagement portion located, with respect to a bottom of the module housing, above a hammer pivot axis of the trigger mechanism, the hammer pivot axis comprising an axis at which a hammer component of the trigger mechanism pivots in the operation of the trigger mechanism.

5. The trigger module of claim 1 wherein the automatic sear includes an upper extremity adapted to engage a bolt carrier of the firearm in operation so as to effect a release movement of the automatic sear.

6. The trigger module of claim 1 wherein the module housing includes:

(a) a base section on which the one or more trigger mechanism mounts are located; and (b) an automatic sear section projecting rearwardly from an upper part of the base section, the automatic sear pin receiving openings being located on the automatic sear section; and (c) wherein a lower extremity of the automatic sear section is offset upwardly from a lower extremity of the base section.

7. The trigger module of claim 6 wherein an upper extremity of the automatic sear section is offset upwardly from an upper extremity of the base section.

8. The trigger module of claim 1 wherein the automatic sear includes:

(a) an automatic sear pin receptacle defining an automatic sear pin receptacle axis;

(b) a tail part extending downwardly with respect to the automatic sear pin receptacle; and (c) a head part with an upper portion extending upwardly with respect to the automatic sear pin receptacle to provide an upper extremity of the head part, and with a lower portion extending downwardly with respect to the automatic sear pin receptacle to provide a lower extremity of the head part, the lower portion of the head part having a narrower dimension than the upper portion of the head part in the direction parallel to the automatic sear pin receptacle axis.

9. The trigger module of claim 8 wherein the lower portion of the head part is eccentric with respect to a centerline of the automatic sear extending transverse to the automatic sear pin receptacle axis.

10. The trigger module of claim 1 wherein the automatic sear biasing element applies a biasing force between a surface of the automatic sear and a surface of the module housing.

11. A trigger module for use with a firearm having an upper receiver and a lower receiver which are connected in an operable condition and may be separated to expose a trigger mechanism area in the lower receiver, the trigger module including:

(a) a module housing including a first side wall spaced apart from a second side wall;

(b) an automatic sear mount on the module housing;

(c) an automatic sear pivotally secured to the module housing on the automatic sear mount;

(d) an automatic sear biasing element mounted on the module housing;

(e) one or more trigger mechanism mounts on the module housing;

(f) a trigger mechanism secured to the module housing on the one or more trigger mechanism mounts;

(g) the module housing, automatic sear, automatic sear biasing element, and trigger mechanism being movable together as a single unit to and from an operating position in the lower receiver; and (h) wherein the module housing includes a base section on which the one or more trigger mechanism mounts are located and an automatic sear section on which the automatic sear mount is located, the automatic sear section projecting rearwardly from an upper part of the base section with a lower extremity of the automatic sear section being offset upwardly from a lower extremity of the base section.

12. The trigger module of claim 11 wherein an upper extremity of the automatic sear section is offset upwardly from an upper extremity of the base section.

13. The trigger module of claim 11 wherein the automatic sear biasing element applies a biasing force between a surface of the automatic sear and a surface of the module housing.

* * * * *